United States Patent [19]

Heikkinen

[11] Patent Number: 4,807,396

[45] Date of Patent: Feb. 28, 1989

[54] SEALING ASSEMBLY

[76] Inventor: Kevin A. Heikkinen, 630 Symes, Royal Oak, Mich. 48067

[21] Appl. No.: 16,032

[22] Filed: Feb. 18, 1987

[51] Int. Cl.[4] ..... E06B 1/70

[52] U.S. Cl. ..... 49/470; 49/484

[58] Field of Search ..... 49/470, 485, 483, 484, 49/469, 467

[56] References Cited

U.S. PATENT DOCUMENTS

| | | | |
|---|---|---|---|
| 322,086 | 7/1885 | Bartholomew | 49/470 |
| 686,051 | 11/1901 | Golden . | |
| 1,429,203 | 9/1922 | Hartstra | 49/483 X |
| 1,554,774 | 9/1925 | Zahner . | |
| 1,750,631 | 3/1930 | Eaglesfield | 49/484 |
| 2,089,669 | 8/1937 | Shadford | 20/69 |
| 2,108,137 | 2/1938 | Oftedal et al. | 49/470 X |
| 2,607,960 | 8/1952 | Olsson | 20/35 |
| 2,705,820 | 4/1955 | Torrence | 20/74 |
| 3,055,969 | 9/1962 | Schaller, Jr. | 49/484 X |
| 3,153,817 | 10/1964 | Pease, Jr. | 20/35 |
| 3,271,919 | 9/1966 | Olton | 52/624 |
| 3,333,385 | 8/1967 | King | 52/624 |
| 3,363,390 | 1/1968 | Crane et al. | 52/716 |
| 3,386,209 | 6/1968 | Starcevic | 49/501 |
| 3,448,543 | 6/1969 | Nykter | 49/470 |
| 3,521,404 | 7/1970 | Hager et al. | 49/468 |
| 3,750,333 | 8/1973 | Vance | 49/501 |
| 3,760,544 | 9/1973 | Gawes et al. | 52/468 |
| 3,786,609 | 1/1974 | Difazio | 52/619 |
| 4,001,974 | 1/1977 | Wright | 49/488 |
| 4,034,511 | 7/1977 | Bursk | 49/488 |
| 4,055,917 | 11/1977 | Coller | 49/469 |
| 4,386,482 | 6/1983 | Quinif | 49/488 |
| 4,411,104 | 10/1983 | St. Aubin | 49/467 X |

FOREIGN PATENT DOCUMENTS

| | | |
|---|---|---|
| 205701 | 10/1959 | Fed. Rep. of Germany . |
| 2405351 | 4/1979 | France . |

*Primary Examiner*—Philip C. Kannan

*Attorney, Agent, or Firm*—Fleit, Jacobson, Cohn & Price

[57] ABSTRACT

A sealing assembly is disclosed which may be attached to exterior closures for openings, such as doors, of a building or dwelling for sealing the bottom of the closure against weather and the like. The sealing assembly includes an elongated plate having at least two steps. Each step is defined by a vertical surface and a horizontal surface. An elongated sill is attached beneath the bottom of the closure along the threshold opposite the elongated plate, and the elongated sill has at least two steps defined by vertical surfaces and horizontal surfaces. A sealing strip is disposed along at least two vertical surfaces of the elongated plate for sealing engagement with the corresponding vertical surfaces of the elongated sill, whereby when the closure is closed an insulating air space is provided between the sealing strips. An exterior door and a method for improving the sealing of exterior doors are also disclosed, which utilize the sealing assembly of the present invention.

20 Claims, 1 Drawing Sheet

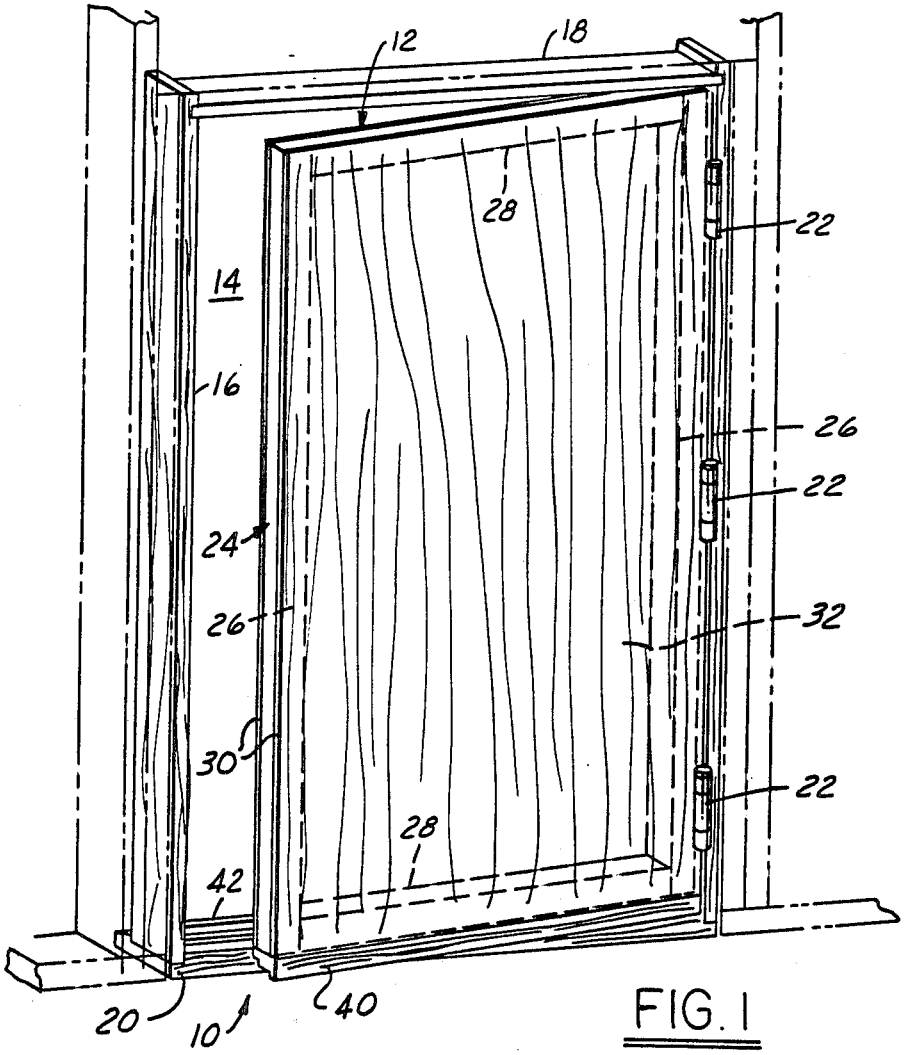
FIG. 1
FIG. 2
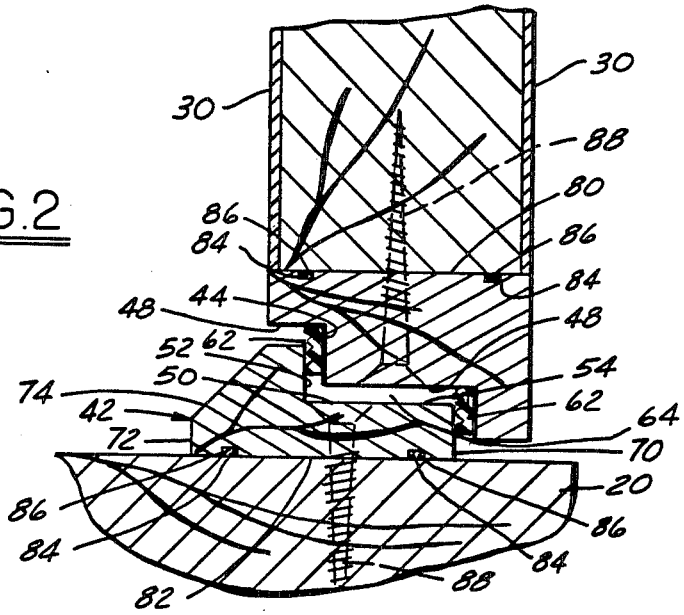

SEALING ASSEMBLY

FIELD OF THE INVENTION

The present invention relates generally to closures for openings, such as doors, primarily adapted for use as exterior doors in buildings or dwellings. More particularly, the present invention relates to a sealing assembly for sealing the bottom of the exterior closure against weather to prevent or limit the flow of air about the bottom of the closure to reduce heating or cooling costs and to eliminate drafts.

BACKGROUND OF THE INVENTION

It has been well recognized within the art as to the desirability of sealing the bottoms of exterior doors against weather including elemental precipitation and dirt, snow, moisture and the like. To accomplish this, the bottoms of the doors have been adapted to include a pair of resilient sealing strips which are sealingly engageable with the thresholds of the doors as disclosed, for example, in U.S. Pat. Nos. 4,386,482 (Quinif), 4,034,511 (Bursk) and 3,521,404 (Hager et al.), or a single resilient sealing strip as disclosed, for example, in U.S. Pat. Nos. 3,750,333 (Vance), 3,153,817 (Pease, Jr.) and 2,089,669 (Shadford) and French Application No. 2,405,351 (Monnier et al.). Also, exterior doors have included weather sealing strips having an actuator element adapted to engage the thresholds to provide a double seal as disclosed, for example, in U.S. Pat. No. 3,448,543 (Multer). However, several limitations and problems have been associated with such assemblies, principal of which is that the sealing strips wear out prematurely because in order to accomplish sealing the strips must rub or drag across the thresholds. This causes the sealing strips to eventually wear to the point that a complete seal is not accomplished. Also, because sealing is depended upon dragging the sealing strip across the threshold or dragging the door across the sealing strip, wearing of the threshold or lodging of debris caused by persons traveling across it over time materially affects the quality of the seal. Further, the door must be precision hung or the bottom tapered to permit compressing of the sealing strip to accomplish sealing. Thus, when conventional sealing assemblies are initially installed, the door is usually hard to open and close and only after repeated use does it begin to require less effort. This reduction in effort, however, is because of the wearing of the seal or the reduction in the resilience of the sealing strips which affects the sealing quality.

In addition to the problems associted with the use of the above assemblies, prior sealing assemblies are either difficult to install or difficult to replace once the sealing strips have become warn, specifically, as disclosed in U.S. Pat. No. 2,089,669 (Shadford) where the bottom of the door must first be tapered to provide for the application of the sealing member. Also, most of the assemblies discussed above are not readily adaptable to use in the after market because of the complexity of the assembly and the difficulty associated with its installation.

SUMMARY OF THE INVENTION

In contrast to the prior art assemblies for sealing the bottoms of exterior doors described above, the sealing assembly of the present invention provides a means for sealing the bottoms of exterior closures for openings, such as doors, without requiring that the sealing strip be dragged or wedged into sealing engagement with the threshold. Also, it will be appreciated that the sealing assembly may be utilized not only for exterior doors but other closures for openings, such as windows and garage doors, in buildings or dwellings to provide a seal not only against the passage of air but also against water which might be driven through the action of the wind or the like. In addition, the present invention is easily installed on existing doors rendering it particularly useful in the after market.

The sealing assembly of the present invention, primarily adapted for sealing the bottom of an exterior closure for an opening, such as a door in the preferred embodiment, in a building or dwelling against weather includes an elongated plate and an elongated sill. The elongated plate includes at least two steps, each step defined by a vertical surface and a horizontal surface. Similarly, the elongated sill includes at least two corresponding steps, each step defined by a vertical surface and a horizontal surface. A sealing means, such as a sealing strip in the preferred embodiment, is disposed along the vertical surfaces of the elongated plate for sealing engagement with the vertical surfaces of the elongated sill.

In the preferred embodiment, the sealing strip is made up of a polymeric material. Also, the vertical surfaces are substantially parallel to one another and the horizontal surfaces are also substantially parallel to one another, and the vertical surfaces and horizontal surface are substantially perpendicular to one another. In the disclosed embodiment, the elongated plate includes at least one groove running the length thereof for facilitating sealing engagement of the elongated plate with the bottom of the exterior closure.

The door of the present invention, primarily adapted for use as an exterior door in a building or dwelling, has a rectangular shaped frame including a pair of opposed vertical stiles joined together at their top and bottom by horizontal rails. The stiles and rails each have an outer peripheral surface, and the opposite vertical faces of the frame are covered by panels secured thereto. A door plate is attached along the outer peripheral surface of the bottom horizontal rail of the door, and the door plate includes at least two steps. One of the steps is defined by a first vertical surface and a second horizontal surface, and the other step is defined by a common horizontal surface and a second vertical surface. An elongated door sill is attached to the dwelling opposite the door plate, and the door plate includes at least two steps. One of the steps is defined by a first vertical surface and a first horizontal surface and the other step is defined by the same first horizontal surface and a second vertical surface. A sealing means, such as a sealing strip of a polymeric material, is disposed along the vertical surfaces of the door plate for sealing engagement with the vertical surfaces of the door sill. Thus, when the door is closed, an insulating air space is provided between the steps to seal the bottom of the door against the weather. In the preferred embodiment, the other step of the door plate is also defined by a second horizontal surface. Also, the vertical surfaces and the horizontal surfaces of the door plate are substantially perpendicular to one another.

The method of the present invention for improving the sealing along the bottoms of exterior doors of building or dwelling against weather includes the step of attaching a door plate along the bottom of the exterior door. The door plate has at least two steps defined by vertical and horizontal surfaces, and sealing means is disposed along at least two vertical surfaces. The next step includes attaching a door sill to the building beneath the bottom of the exterior door opposite the door plate. The door sill has at least two steps defined by vertical and horizontal surface. Thus, when the door is closed, the horizontal surfaces of the door plate are spaced apart from the horizontal surfaces of the door sill, and the vertical surfaces of the door sill come in sealing engagement with the sealing means disposed along the vertical surfaces of the door plate to seal the bottom of the door against the weather.

In the preferred method, the step of squaring the bottom of the exterior door before attaching the door plate thereto is included. Also, the method further includes the step of placing an additional sealing means between the bottom of the exterior door and the door plate before attaching the door plate along the bottom of the exterior door to seal the joint therebetween. Likewise, the method further includes the step of placing an additional sealing means between the dwelling and the door sill before attaching the door seal to the dwelling to seal the joint therebetween. Further, when the door is closed, at lesat one insulating air space is formed between the door plate and door sill.

DESCRIPTION OF THE DRAWINGS

The various features, objects, benefits and advantages of the present invention will become more apparent by reading the following detailed description in conjunction with the drawing where like reference numerals identify corresponding components, and:

FIG. 1 is a perspective elevational view of an exterior door utilizing the sealing assembly of the present invention; and FIG. 2 is a fragementary end view, partly in section, illustrating the details of the sealing assembly when the exterior door is closed.

DETAILED DECRIPTION OF THE PREFERRED EMBODIMENT

Referring to FIG. 1, the sealing assembly of the present invention, generally designated 10, is illustrated in use on an exterior closure for an opening, such as a door 12, adapted for mounted disposition within a conventional doorway or opening 14 for swinging in a predetermined direction. The door opening is defined by side members 16, a header 18 and a threshold 20. The door is carried by hinges 22 and may include a latch mechanism (not shown).

The particular door 12 is not essential to the present invention and may include both wooden and metal doors of the types, for example, disclosed above or in U.S. Pat. Nos. 3,786,609 (Difazio), 3,386,209 (Starcevic), 3,271,919 (Olton) and 1,554,774 (Zahner). Each door, whether hollow or solid core, typically includes a rectangular frame 24 formed by a pair of longitudinally extending stiles 26 along opposite vertical sides and opposed to one another. These stiles 26 ,or elements corresponding to and functioning as stiles, form the hinged side or edge of the door and the striker side or edge of the door. The stiles 26 are interconnected by transversely extending horizontal rails 28 at least at the top and bottom of each door 12. Additional rails may be provided for reinforcement, as necessary, and for mounting the latch mechanism or lock (not shown). It should also be appreciated that the sealing assembly 10 may be utilized for sealing other types of closures for openings such as, for example, windows, garage doors and the like without departing from the present invention.

The opposite vertical faces of the door 12 are covered by a pair of panels 30 made of wood, metal or other materials bonded to the frame 24. In situations where metal panels 30 are utilized, it is important to prevent metal to metal contact to minimize heat transfer by way of the metal panels. Thus, the panels may be adhesively bonded to the wood frame 24 by means of a suitable adhesive to prevent separation and in the case of metal panels the edges may be bent and inserted within a peripheral groove (not shown) and spaced apart from one another.

The interior space 32 of the door may include a solid core or in some cases a hollow core. A solid core may be made from a number of commercially avalable plastic materials, as for example from those selected among the polyurethanes. Thus, where desired, the core may be filled with a suitable foam plastic filler within the interior space 32 formed between the frame 24, and the panels 30, and bonded thereto to thereby further rigidify and solidify the door 12.

To manufacture such a door unit, first the frame 24 is constructed out of suitable wood strips for the stiles 26 and rails 28 and thereafter the panels 30 are applied. Where a foam filling material is appleid within the interior space 32 of the door, it may be applied by inserting unfoamed beads of foamable polyurethane or the like plastic which may then be foamed in place by the application of heat to the completed door for expansion and filling the spaces within the door and bonding to the panels 30.

The sealing assembly 10 of the present invention, as illustrated in FIG. 1 and in greater detail in FIG. 2, when used on an exterior door includes an elongate door plate 40 mounted along the outer peripheral surface of the bottom rail of the door 12, by screws, adhesives or the like. The door plate is engageable with an elongated door sill 42 attached across the threshold 20 of the door opening 14 opposite the door plate 40. The door plate 40 includes at least two plate steps 44, each defined by a vertical surface 46 and a horizontal surface 48. Likewise, the door sill 42 includes at least two sill steps 50, each defined by a vertical surface 52 and a horizontal surface 54. In the preferred embodiment, one of the sill steps 50 is defined by the vertical surface 52 and the horizontal surface 54 and the other or second step 50 is only defined by the vertical surface 52 and the common horizontal surface 54 and the threshold 20. The vertical surfaces 46 and 52 are substantially parallel to one another, and the horizontal surfaces 48 and 52 are also substantially parallel to one another. In addition, the horizontal surfaces and vertical surfaces in the preferred embodiment are substantially perpendicular to one another.

A continuous sealing surface is associated with each vertical surface 52 of the door sill 42 for engagement with a sealing means, such as a resilient polymeric strip 62 in the preferred embodment. The sealing strip 62 is attached along the vertical surfaces 46 of the door plate 40 such that sealing strip and vertical surface of the door sill 42 should remain a line of mutual contact regardless of vertical movement of the door sill or door plate with respect to one another. The particular sealing means is not essential to the present invention and may be manufactured or fabricated from any suitable polymeric material or the like, such as for example vinyl compounds, which are resilient and demonstrate good weatherability. The manufacturer of this product will select the best material based upon manufacturing process and availability. In the preferred embodiment, the sealing strip 62 is of a polymeric material having been extruded into a generally K, P or V-shape. A K-shaped sealing strip 62 is illustrated in FIG. 2 which has been found to be the least likely of the three shapes to wear and tear, and because it is thicker, it should be more durable to provide better sealing capability. The sealing strip is coextensive with the width of the door and stapled and/or adhesively adhered to the vertical surfaces 46 of the door plate 40 along one side. If a V-shaped sealing strip (not shown) is utilized, the point of the V of the strip should be pointed upwardly toward the door to prevent debris from becoming lodged or accumulated within the strip, thereby affecting sealing.

The steps 44 and 50 are situated in descending order relative to the front and the back of the door 12, whereby when the door is closed an air space 64 is provided between the two sealing strips 62 to enhance the insulating quality of the door sealing assembly 10. This way, if one of the sealing strips should become damaged or fail the other strip 62 will at least prevent air from blowing through. Also, if both sealing strips 62 should fail the air most likely will have to take a circuitous path to pass beneath the bottom of the door 12. In the illustrated embodiment, only two steps are illustrated for the door plate 40 and the door sill 42 to form primary and secondary steps and sealing strips for sealing purposes. However, it should be appreciated that a plurality of steps and corresponding sealing strips may be utilized to form at least one air space between the door plate 40 and door sill 42 when the door is closed.

In addition, the door sill 42 includes a heal 70 and a toe 72 with the toe being exposed to the exterior and including a beveled surface 74 inclined relative to the threshold 20 to minimize tripping when a person passes thereover.

In the preferred embodiment, as illustrated in FIG. 2, the door plate 40 includes a base 80 and the door sill 42 also includes a base 82. A pair of grooves 84 run the length of each base 80 and 82 of the door plate 40 and the door sill 42. Thus, a sealing material 86, such as putty, epoxy or the like, may be manually applied to the grooves while viscous, like a strip of rope, to seal the joints of the door plate 40 and the bottom of the door 12 and the door sill 42 and the threshold 20.

The lengths of the door plate 40 and the corresponding door sill 42 are not significant to the present invention. However for sealing purposes, it is preferred that they be the same length and extend the entire width of the door opening 14. Thus, for conventional door widths of 32, 34 or 36 inches, for example, the door sealing assembly 10 of the present invention should be appropriately dimensioned to seal the entire bottom of the door 12.

The particular materials of which the door plate 40 and the door sill 42 are made is not essential to the present invention and may include, for example, woods, extruded metals or a combination thereof, such as a metal covering or encasing wood. A soft wood, such as pine, has been successfully utilized for prototypes and found to be economical to manufacture the door plate 40 and door sill 42, but it is contemplated that hard woods, such as oak, or extruded metals, such as aluminum, will be preferred because of their durability. However, the manufacture of the sealing assembly may utilize other materials based upon economics, availability and manufacturing process.

OPERATION AND USE

The operation and use, specifically the installation, of the sealing assembly 10 of the present invention will now be explained. Initially, the sealing material 86, such as putty, is placed in the grooves 84 of the door plate 40 before it is attached to the bottom of the exterior door 10 by screws 88. Next, the putty 86 is placed in the grooves 84 of the door sill 42 before it is attached across the threshold 20 of the door opening 14. Initially, it may be necessary to square off the bottom of the exterior door 10 before attaching the door plate 40 thereto for use in the after market if the door was previously so cut, or it may be desirable to so shape the door plate 40 to eliminate the necessity for squaring the bottom of the exterior door. It should also be appreciated that the sealing assembly 10 of the present invention may be attached along the stiles 26 and the rail 28 of the door 12 to seal the sides and the top.

While the preferred embodiment of the present invention has been described so as to enabled one skilled in the art to practice the techniques of the present invention, the preceding description is intended to be exemplary and should not be used to limit the scope of the invention. The scope of the invention should be determined only be reference to the following claims.

I claim:

1. A door, primarily adapted for use as an exterior door in a building or dwelling, having a rectangular shaped frame including a pair of opposed vertical stiles joined together at their top and bottom by horizontal rails, said stiles and said rails each having an outer peripheral surface, the opposite vertical faces of said frame being covered by panels secured to the faces of the frame, comprising:

a sealing assembly including a door plate and a door sill opposed to one another such that when said door is closed said door plate and said door sill may be brought into abutting contact with one another along vertical surfaces;

said door plate having a set of steps including at least two steps, one of said steps including a first vertical surface and said other step including a second vertical surface;

said door sill having a set of steps including at least two steps, one of said steps including a first vertical surface and said other step including a second vertical surface; and sealing means disposed along the vertical surfaces of one set of steps for sealing engagement with the vertical surfaces of the other set of steps with said door plate and said door sill spaced apart from one another to form an insulating air space between said steps to seal the bottom of said door against the weather when said door is closed.

2. The door defined in claim 1, wherein the other step of said door plate also includes a horizontal surface.

3. The door defined in claim 2, wherein the vertical surfaces and the horizontal surface of said door plate are substantially perpendicular to one another.

4. The door defined in claim 1, wherein said sealing means includes a sealing strip of a polymeric material.

5. A removable sealing assembly primarily adapted for sealing the bottom of an exterior closure for an opening, such as a door, in a building or dwelling against weather, comprising:

an elongated plate including at least two steps with each step defined by a vertical surface and a horizontal surface;

an elongated sill including at least two steps with each step defined by a vertical surface and a horizontal surface;

attaching means for removably attaching said elongated plate along the bottom of said exterior closure and for removably attaching said elongated plate along said building or dwelling opposite said elongated plate such that when said exterior closure is closed the vertical surfaces of said elongated plate and said elongated sill may be brought into abutting contact with one another with the horizontal surfaces of said elongated plate and said elongated sill spaced apart from one another; and sealing means disposed between the vertical surfaces of said elongated plate and said elongated sill for sealing engagement with the vertical surfaces to form an insulating air space when said exterior closure is in a closed position.

6. The sealing assembly defined in claim 5, wherein said vertical surfaces are substantially parallel to one another and said horizontal surfaces are substantially parallel to one another.

7. The sealing assembly defined in claim 5, wherein said elongated sill further comprises a toe and a heal, said toe being exposable to the exterior and including a beveled surface.

8. The sealing assembly defined in claim 5, wherein said elongated plate further comprises a front and back and a primary step and a secondary step, said primary step adjacent said front and said secondary step adjacent said back.

9. The sealing assembly defined in claim 8, wherein said steps are situated in descending order relative to said exterior closure from said front to said back of said elongated plate.

10. The sealing assembly defined in claim 5, wherein the vertical surfaces of said elongated sill further comprise continuous sealing surfaces.

11. The sealing assembly defined in claim 5, wherein said elongated plate includes at least one groove running the length thereof for facilitating sealing engagement of said elongated door plate with the bottom of said exterior closure.

12. The sealing assembly defined in claim 5, wherein said sealing means includes an elongated sealing strip of a polymeric material.

13. The selaing assembly defined in claim 5, wherein two of said steps of said elongated sill are defined by a common horizontal surface.

14. The sealing assembly defined in claim 5, wherein said sealing means is attached along the vertical surfaces of said elongated plate and disposed between the vertical surfaces of said elongated plate and said elongated sill when in sealing engagement.

15. The sealing assembly defined in claim 5, wherein said sealing means is attached along at least two vertical surfaces of said elongated plate to form at least one insulating air space therebetween when in sealing engagement.

16. A method for improving the sealing along the bottoms of exterior closures for openings, such as doors, of buildings or dwellings against weather, comprising the following steps:

attaching a door plate along the bottom of said exterior door by a means, said door plate having at least two steps defined by vertical and horizontal surfaces; and attaching a door sill to the building beneath the bottom of said exterior door opposite said door plate by a means, said door sill having at least two steps defined by vertical and horizontal surfaces, whereby when said door is closed, said horizontal surfaces of said door plate are spced apart from said horizontal surfaces of said door sill and said vertical surfaces of said door sill may come in contact with one another;

disposing sealing means between said vertical surfaces of said door plate and said door sill to form an insulating air space defined by said vertical surfaces and said horizontal surfaces between said door sill and said door plate when said exterior closure is in a closed position.

17. The method defined in claim 16, further comprising the step of squaring the bottom of said exterior door before attaching said door plate thereto.

18. The method defined in claim 16, further comprising the step of removable attaching said door sill to said dwelling by at least one screw.

19. The method defined in claim 16, further comprising the step of placing an additional sealing means between the bottom of said exterior door and said door plate before attaching said door plate along the bottom of said exterior door to seal the joint therebetween.

20. The method defined in claim 19, further comprising the step of placing an additional sealing means between the dwelling and said door sill before attaching said door sill to said dwelling to seal the joint therebetween.

* * * * *